US011260506B2

(12) United States Patent
Su et al.

(10) Patent No.: US 11,260,506 B2
(45) Date of Patent: Mar. 1, 2022

(54) PNEUMATIC RATCHET WRENCH AND OUTER SHELL THEREOF

(71) Applicant: Basso Industry Corp., Taichung (TW)

(72) Inventors: San-Yih Su, Taichung (TW); Cheng-Wei Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 411 days.

(21) Appl. No.: 16/260,369

(22) Filed: Jan. 29, 2019

(65) Prior Publication Data

US 2019/0240816 A1 Aug. 8, 2019

(30) Foreign Application Priority Data

Feb. 6, 2018 (TW) ..... 107104122

(51) Int. Cl.
*B25B 21/00* (2006.01)
*B25B 13/46* (2006.01)

(52) U.S. Cl.
CPC ..... *B25B 21/005* (2013.01); *B25B 13/465* (2013.01)

(58) Field of Classification Search
CPC ..... B25B 21/00; B25B 21/02; B25B 21/002; B25B 21/004; B25B 21/005; B25B 13/465; B25B 13/48; B25B 13/481; B25B 13/5091; B25B 17/00; B25B 21/023; B25B 23/14; B23B 45/04; E21B 19/16; A61B 17/1626; A61B 2017/00544
See application file for complete search history.

(56) References Cited

U.S. PATENT DOCUMENTS 3,483,932 A * 12/1969 Jaulmes ..... B60B 31/02 173/177
4,821,611 A * 4/1989 Izumisawa ..... B25B 21/004 173/93.6
7,032,685 B2 4/2006 Nakamizo
2013/0319714 A1* 12/2013 Su ..... B25B 21/00 173/221
2014/0326112 A1* 11/2014 Lai ..... B25B 21/02 81/464

FOREIGN PATENT DOCUMENTS

CN 203077180 U 7/2013
TW 309829 U 7/1997
TW I331954 B 10/2010
TW M511926 U 11/2015

OTHER PUBLICATIONS

A Search Report appended to an Office Action, which was issued to Taiwanese counterpart application No. 107104122 by the TIPO dated Aug. 31, 2021, with an English translation thereof.

* cited by examiner

*Primary Examiner* — Robert J Scruggs
(74) *Attorney, Agent, or Firm* — Burris Law, PLLC

(57) ABSTRACT

A pneumatic ratchet wrench includes a main body formed with a receiving chamber, a head unit, a driving unit and an air motor. The head unit defines a gas passage, and includes a ring portion and a frame portion. The ring portion includes an exit in spatial communication with the gas passage and opens toward the frame portion. The driving unit includes a driving head, and a transmission shaft mounted in the head unit. The air motor drives the transmission shaft and includes a cylinder and a rotor. The cylinder includes a venting hole allowing gas produced in the cylinder to pass through the venting hole and the gas passage and to exit from the exit to be blown toward the frame portion.

19 Claims, 13 Drawing Sheets

PNEUMATIC RATCHET WRENCH AND OUTER SHELL THEREOF

CROSS-REFERENCE TO RELATED APPLICATION

This application claims priority of Taiwanese Patent Application No. 107104122, filed on Feb. 6, 2018.

FIELD

The disclosure relates to a pneumatic ratchet wrench and an outer shell thereof.

BACKGROUND

U.S. Pat. No. 4,821,611 A discloses a conventional tightening device. Referring to FIG. 1 of U.S. Pat. No. 4,821,611 A, the conventional tightening device includes a body 4, a casing 8, a connecting member 23 and a housing 24 that are interconnected along an axis. The conventional tightening device further includes an air motor 1, a rotatable tightening portion 33, an impact spindle 11 for transmitting driving force from the air motor 1 to the rotatable tightening portion 33, and an impact clutch mechanism 9 for striking the impact spindle 11. The casing 8 includes a first exhaust passage 19 for guiding the gas produced by the air motor 1. The connecting member 23 includes a second exhaust passage 29 that blows the gas outwardly through a fore port 34. The blown gas may be used for cooling down the rotatable tightening portion 33.

However, since the rotatable tightening portion 33 is connected to a front end of the housing 24 and is spaced apart from the fore port 34 formed in the connecting member 23, the gas blown through the fore port 34 may be dissipated into the ambient environment and not onto the rotatable tightening portion 33, resulting in an inferior cooling effect.

Moreover, the first exhaust passage 19 formed in the casing 8 and the second exhaust passage 29 formed in the connecting member 23 may cause the casing 8 and the connecting member 23 to be greater in dimension, which is inconvenient or uncomfortable for a user to handle.

SUMMARY

Therefore, a first aspect of the disclosure is to provide a pneumatic ratchet wrench that includes a main body, a head unit, a driving unit and an air motor.

The main body includes a receiving chamber that extends along a central axis. The head unit defines at least one gas passage, and includes a ring portion that is detachably connected to the main body, and a frame portion that extends from the ring portion of the head unit in a direction parallel to the central axis and away from the main body. The ring portion of the head unit includes at least one exit that is in spatial communication with the gas passage and that opens toward the frame portion. The driving unit includes a driving head that is rotatably mounted to the frame portion and that is rotatable about a rotating axis perpendicular to the central axis, and a transmission shaft that is mounted to the head unit, that extends along a direction parallel to the central axis and that transmits a driving force to the driving head. The air motor is disposed in the receiving chamber of the main body, and pneumatically drives the transmission shaft. The air motor includes a cylinder and a rotor. The cylinder includes a venting hole that allows gas produced in the cylinder to pass through the venting hole and the gas passage, and to exit from the exit to be blown toward the frame portion.

A second aspect of the disclosure is to provide an outer shell of the pneumatic ratchet wrench. The outer shell includes the main body and the head unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
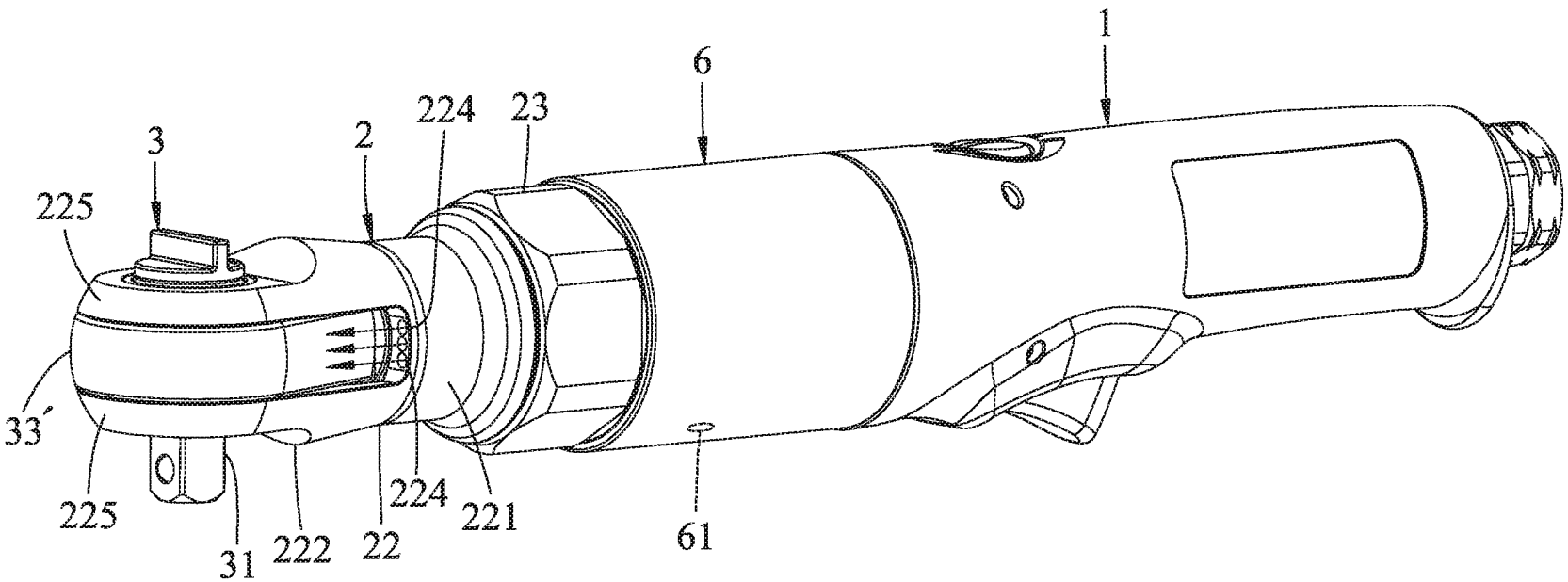
FIG. 1 is a perspective view of a first embodiment of a pneumatic ratchet wrench according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
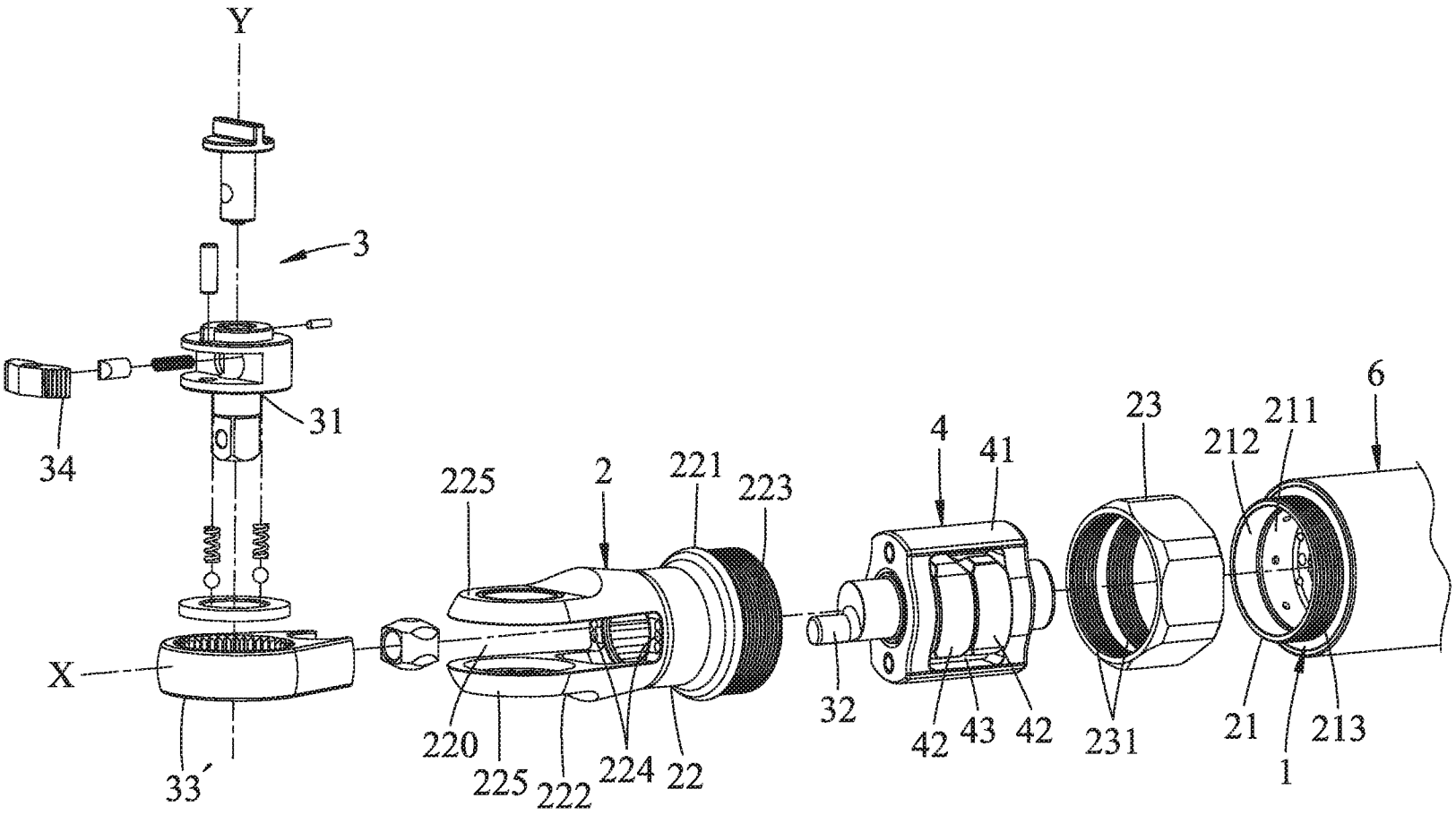
FIG. 2 is a fragmentary and partially exploded perspective view of the first embodiment.

Referring to FIGS. 1 and 2, a first embodiment of a pneumatic ratchet wrench according to the present disclosure includes a main body 1, a head unit 2, a driving unit 3, a striking unit 4, an air motor 5 and a collar 6. In this embodiment, the main body 1 and the head unit 2 cooperate to constitute an outer shell of the pneumatic ratchet wrench.

Figure 3:
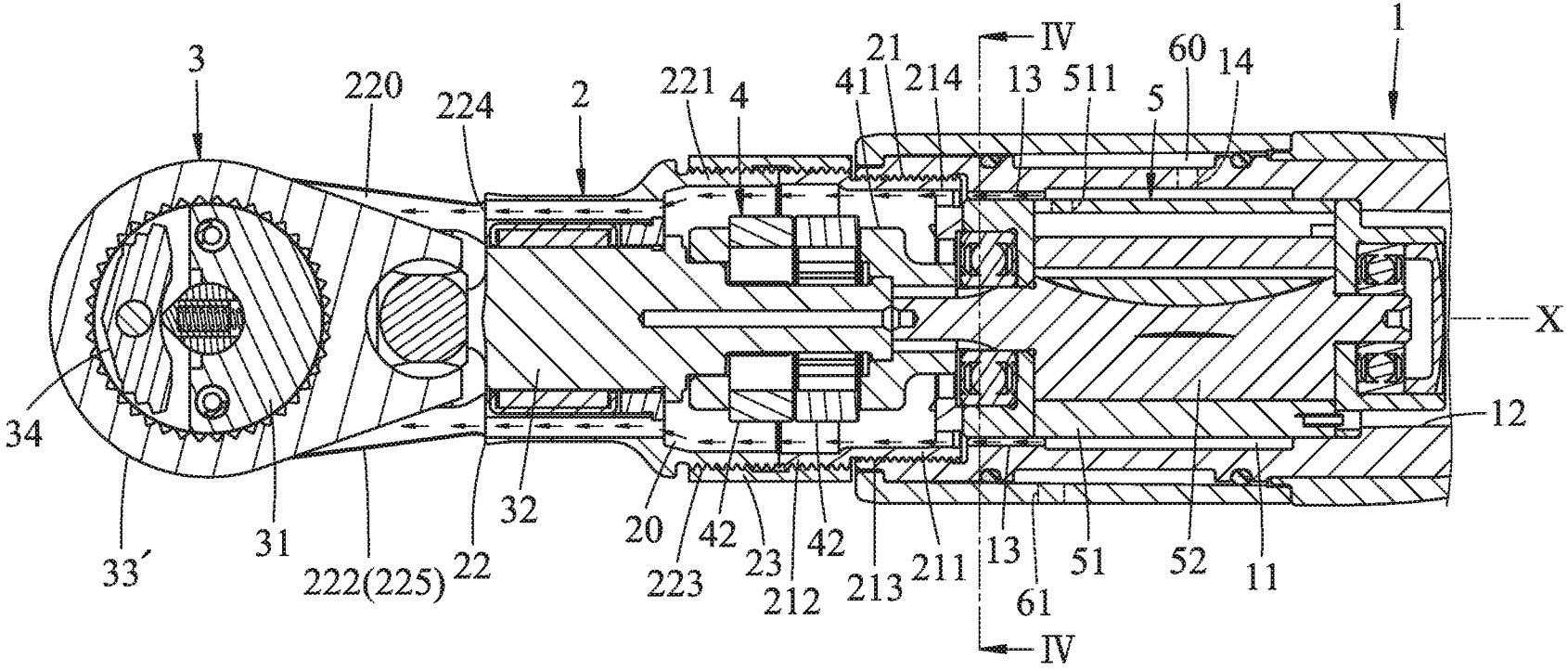
FIG. 3 is a fragmentary sectional view of the first embodiment.
Figure 4:
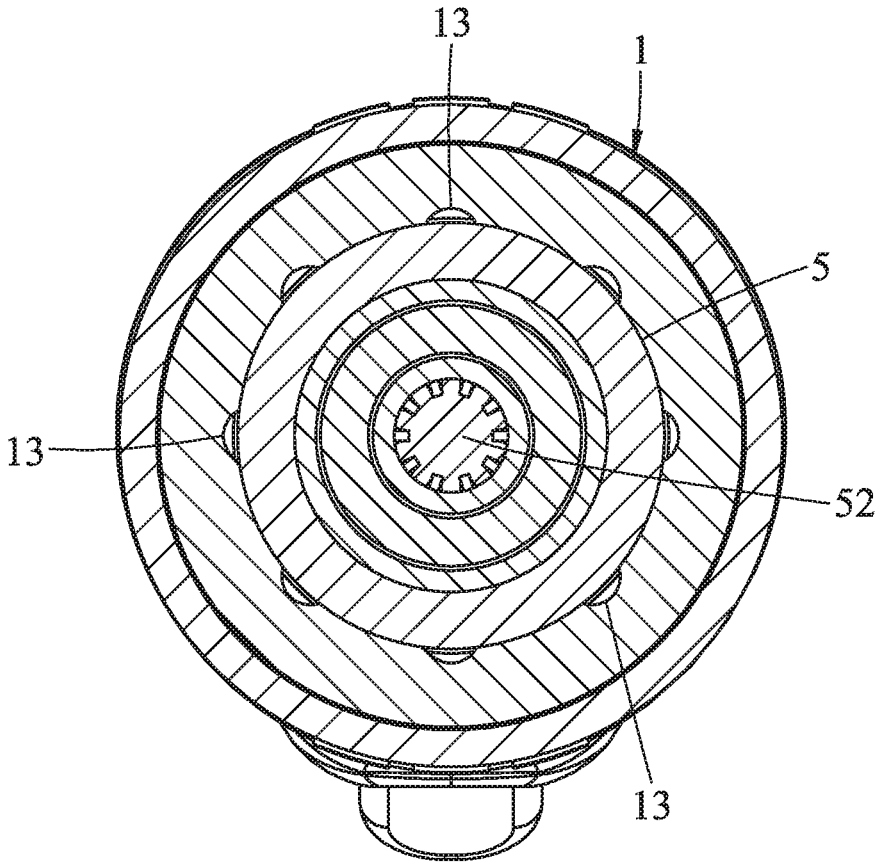
FIG. 4 is a sectional view of the first embodiment, taken along line IV-IV of FIG. 3.

Further referring to FIGS. 3 and 4, the main body 1 includes an inner surface 12 that surrounds a central axis (X) and that defines a receiving chamber 11 extending along the central axis (X), a plurality of passages 13 that are formed in the inner surface 12 and that surround and extend along the central axis (X), and a plurality of vent holes 14 that extend along a direction perpendicular to the central axis (X) and that are spatially communicated with the receiving chamber 11.

The head unit 2 defines a transmission room 20 that extends along the central axis (X), and a pressing ring 21, a head 22 and a packing ring 23.

In this embodiment, the transmission room 20 constitutes a gas passage.

The pressing ring 21 includes a pressing ring portion 211 that is detachably connected to a front end of the main body 1, a connection portion 212 that is opposite to the pressing ring portion 211, and an external thread 213 that is formed in an outer surface of the pressing ring portion 211 and an outer surface of the connection portion 212. The pressing ring portion 211 is threadedly connected to the main body 1 via the external thread 213, and includes a plurality of entrances 214 that surround the central axis (X) and that are in spatial communication with and disposed between the receiving chamber 11 and the transmission room 20 via the passages 13.

The head 22 includes a ring portion 221, a frame portion 222 and an external thread 223. The ring portion 221 is connected to the connecting portion 212, and cooperates with the connecting portion 212 to surround the central axis (X) and to define the transmission room 20. The frame portion 222 extends from the ring portion 221 in a direction parallel to the central axis (X) and away from the main body 1. The external thread 223 is formed in an outer surface of the ring portion 221 of the head unit 2. The ring portion 221 includes a plurality of exits 224 that open toward the frame portion 222, and that are in spatial communication with the transmission room 20 (i.e., the gas passage). The frame portion 222 is bifurcated and includes two frames 225 that define a space 220 therebetween. In this embodiment, the exits 224 are arranged in two groups that are respectively located at two sides of the central axis (X), and face the space 220.

The packing ring 23 surrounds the connecting portion 212 of the pressing ring 21 and the ring portion 221 of the head 22, and includes two internal threads 231 that are respectively and threadedly engaged with the external thread 213 of the pressing ring 21 and the external thread 223 of the head 22.

Referring to FIGS. 2 and 3, the driving unit 3 includes a driving head 31, a transmission shaft 32, a yoke 33' and a pawl unit 34. The driving head 31 is rotatably mounted to the frames 225 of the frame portion 222 and is rotatable about a rotating axis (Y) perpendicular to the central axis (X). The transmission shaft 32 is received in the transmission room 20, extends along the central axis (X), and transmits a driving force to the driving head 31. The yoke 33' surrounds the driving head 31 and is rotatably received in the space 220 between the frames 225. The pawl unit 34 is disposed between the driving head 31 and the yoke 33' for limiting the driving head 31 to rotate unidirectionally (i.e., only clockwise or only counterclockwise).

The striking unit 4 is disposed in the transmission room 20 of the head unit 2, and includes a striking seat 41, two striking blocks 42 and two pins 43. The striking blocks 42 extend through the striking seat 41, and are connected to an end of the transmission shaft 32. The pins 43 are disposed between the striking seat 41 and the striking blocks 42, and are operable to strike the transmission shaft 32.

The air motor 5 is disposed in the receiving chamber 11 of the main body 1, and pneumatically drives the transmission shaft 32. In this embodiment, the air motor 5 includes a cylinder 51 and a rotor 52. The cylinder 51 is pressed by the pressing ring portion 211 of the pressing ring 21 to be positioned in the receiving chamber 11, and includes a venting hole 511 that allows gas produced in the cylinder 51 to pass through the venting hole 511 into the receiving chamber 11.

The collar 6 surrounds the main body 1 and a portion of the pressing ring portion 211, and cooperates with the main body 1 and the connection portion 212 of the pressing ring 21 to define a venting space 60 that is in spatial communication with the vent holes 14. The collar 6 includes a venting opening 61 that spatially communicates the venting space 60 with ambient environment.

Referring to FIGS. 2 and 3, when the rotor 52 of the air motor 5 is pneumatically driven by the gas in the cylinder 51 to rotate so as to drive the transmission shaft 32 and the striking unit 4, such that the yoke 33' rotate alternatively clockwise and counterclockwise to drive unidirectional rotation of the driving head 31 to achieve fastening or unfastening of a bolt (not shown). When the bolt is tightened to a certain degree, the driving head 31, the yoke 33' and the transmission shaft 32 would stop rotating because of resistance force applied to the bolt, and a counter force would be applied to the pins 43. As a result, the striking blocks 42 strike the transmission shaft 32 to further drive the driving head 31 to rotate by a very small angle, so as to further tighten the bolt.

Referring to FIGS. 1 and 3, during rotation of the driving head 31, the gas exiting the cylinder 51 through the venting hole 511 will be separated into two streams, one of which sequentially passes through the receiving chamber 11, the vent holes 14, the venting space 60 and the venting opening 61 to exit the pneumatic ratchet wrench, and the other one of which sequentially passes through the passages 13 of the receiving chamber 11, the entrances 214 of the pressing ring portion 211 of the pressing ring 21, the transmission room 20 and the exits 224 to be blown toward the space 220 between the frames 225, so as to cool the yoke 33' (see the arrows in FIG. 3).

Alternatively, the venting hole 511 may be in direct and spatial communication with the transmission room 20 such that the gas exiting the cylinder 51 through the venting hole 511 can enter the transmission room 20 without passing through the receiving chamber 11. In addition, the gas passage may be formed between the pressing ring 21 and the head 22, and be in spatial communication with the receiving chamber 11 and the exits 224, or may be in spatial communication with the venting hole 511 and the exits 224.

Figure 5:
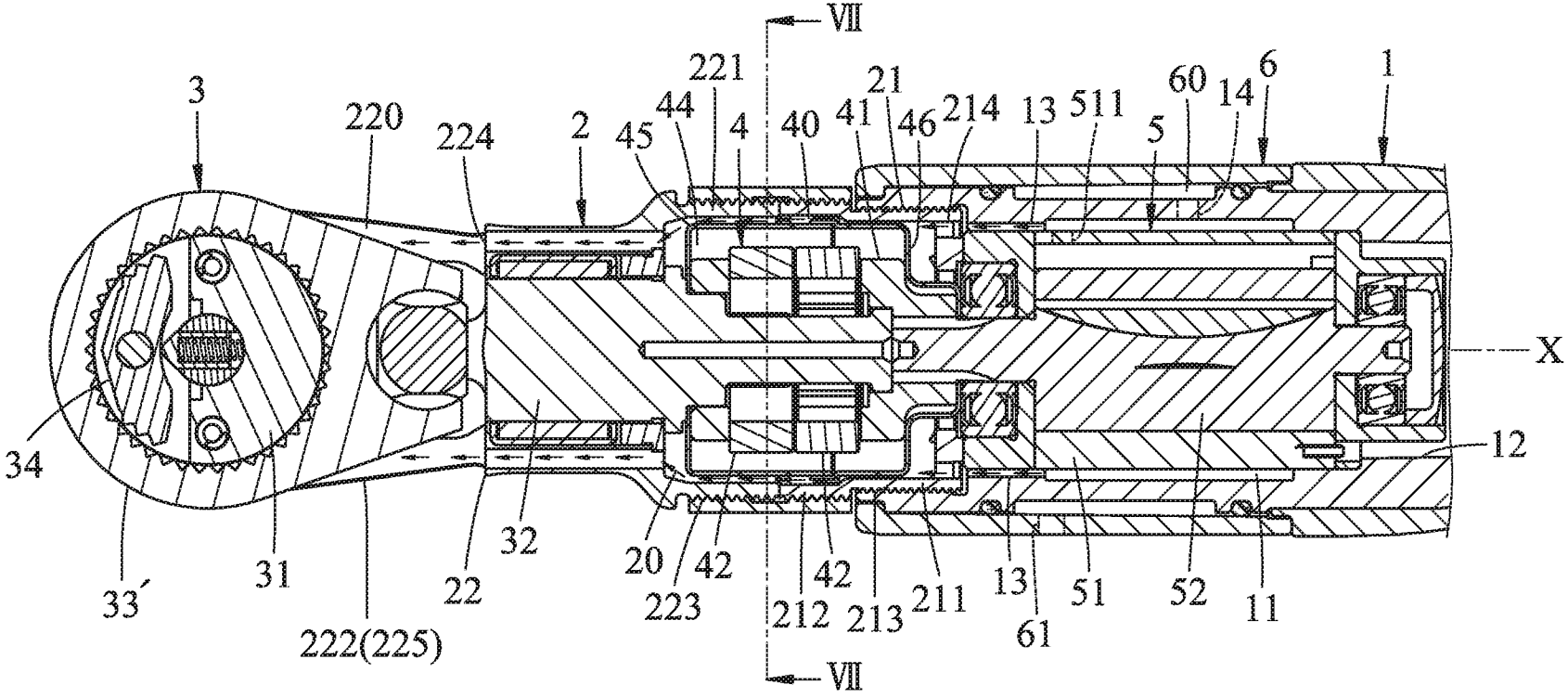
FIG. 5 is a fragmentary sectional view of a second embodiment of the pneumatic ratchet wrench according to the present disclosure.
Figure 6:
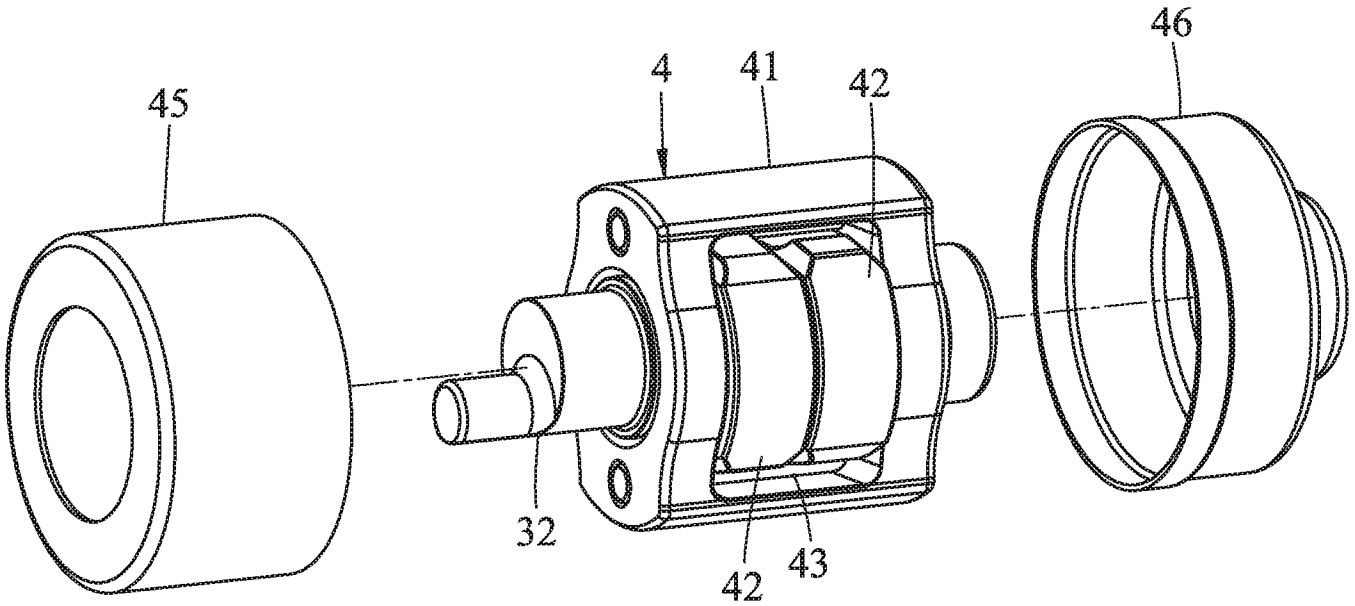
FIG. 6 is a partially exploded perspective view of a striking unit of the second embodiment.
Figure 7:
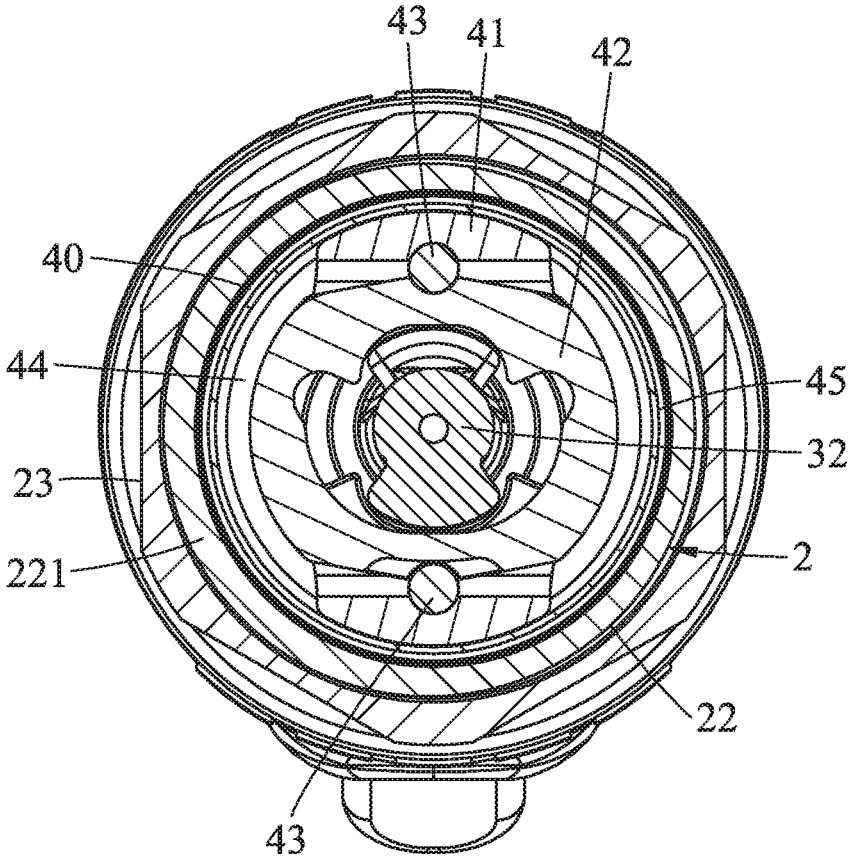
FIG. 7 is a sectional view of the second embodiment, taken along line VII-VII of FIG. 5.

Referring to FIGS. 5 to 7, a second embodiment of the pneumatic ratchet wrench according to the present disclosure has a structure similar to that of the first embodiment, with differences described below. In the second embodiment, the striking unit 4 further includes an annular seat 45, and an annular cover 46 that is connected to the annular seat 45 and that cooperates with the annular seat 45 to define a retaining space 44 receiving the striking seat 41. The annular seat 45 cooperates with the annular cover 46 and the head unit 2 to define an annular passage 40 that surrounds the central axis (X) and that is in spatial communication with and disposed between the entrance 214 and the exit 224.

During rotation of the driving head 31, the gas exiting the cylinder 51 through the venting hole 511 is also separated into two streams, one of which sequentially passes through the receiving chamber 11, the passages 13, the entrances 214 of the pressing ring portion 211 of the pressing ring 21, the annular passage 40 and the exits 224 to be blown toward the space 220 between the frames 225, so as to cool the yoke 33' (see the arrows in FIG. 5).

It is worth mentioning that the annular seat 45 and an annular cover 46 may effectively retain the lubricant within the retaining space 44 so as to effectively lubricate the striking seat 41, the striking blocks 42, the pins 43 and the transmission shaft 32.

Figure 8:
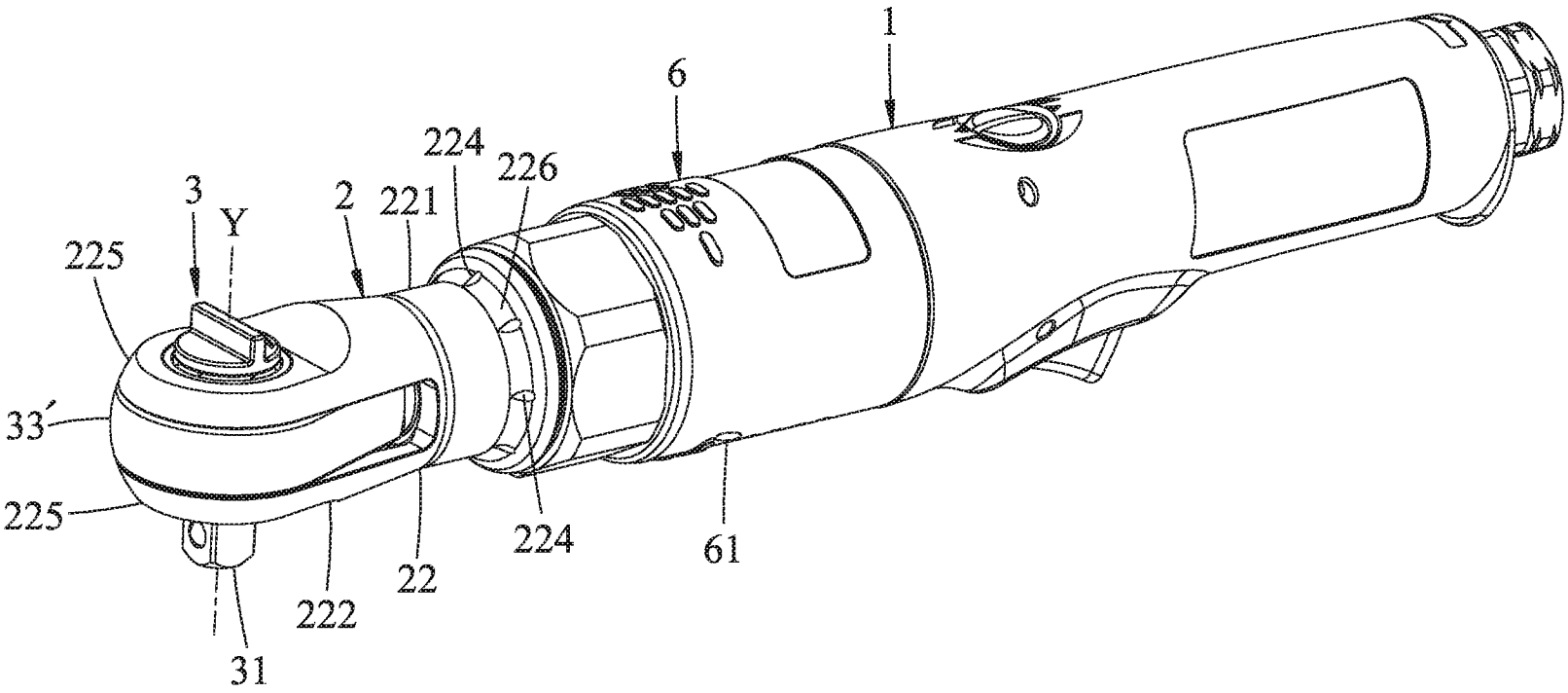
FIG. 8 is a perspective view of a third embodiment of the pneumatic ratchet wrench according to the present disclosure.
Figure 9:
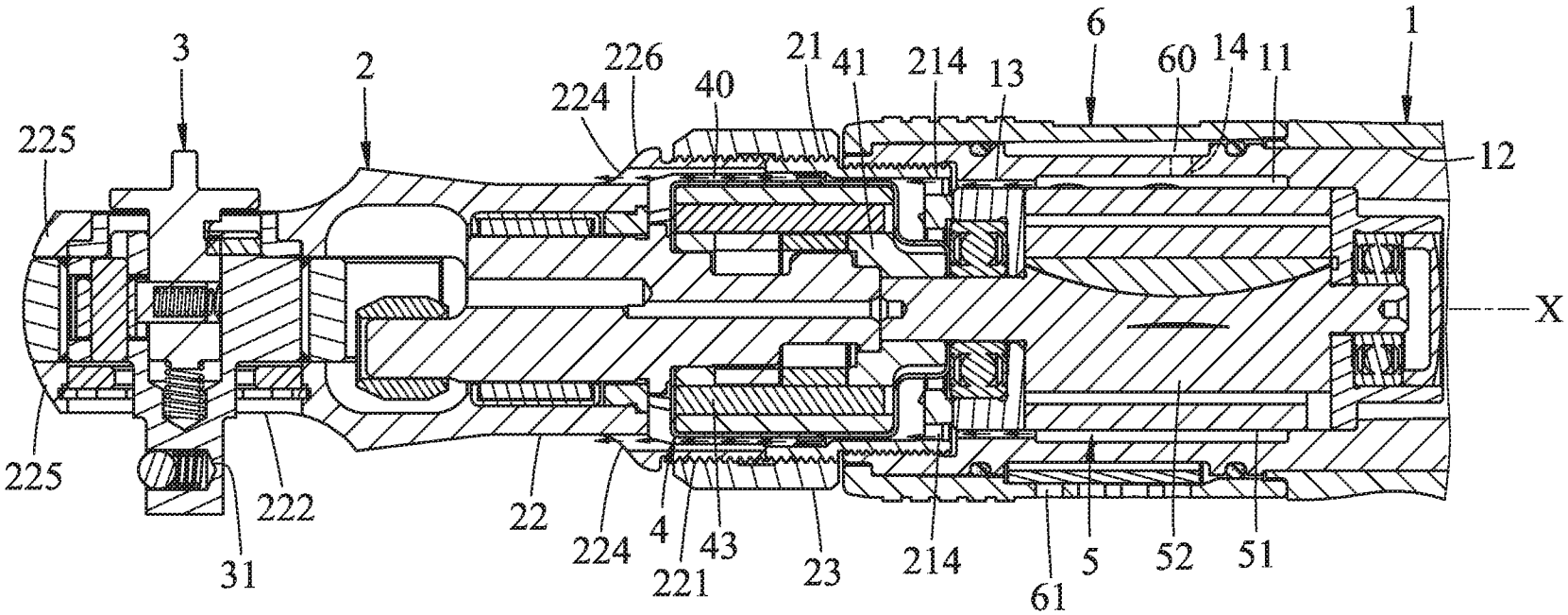
FIG. 9 is a fragmentary sectional view of the third embodiment.

Referring to FIGS. 8 and 9, a third embodiment of the pneumatic ratchet wrench according to the present disclosure has a structure similar to that of the second embodiment, with differences described below. In the third embodiment, the ring portion 221 of the head unit 2 further includes a stepped portion 226. The exits 224 are formed in the stepped portion 226.

During rotation of the driving head 31, the gas exiting the cylinder 51 through the venting hole 511 is also separated into two streams, one of which sequentially passes through the receiving chamber 11, the passages 13, the entrances 214 of the pressing ring portion 211 of the pressing ring 21, the annular passage 40 and the exits 224 to be blown toward the space 220 between the frames 225, so as to cool the yoke 33' (see the arrows in FIG. 9).

Figure 10:
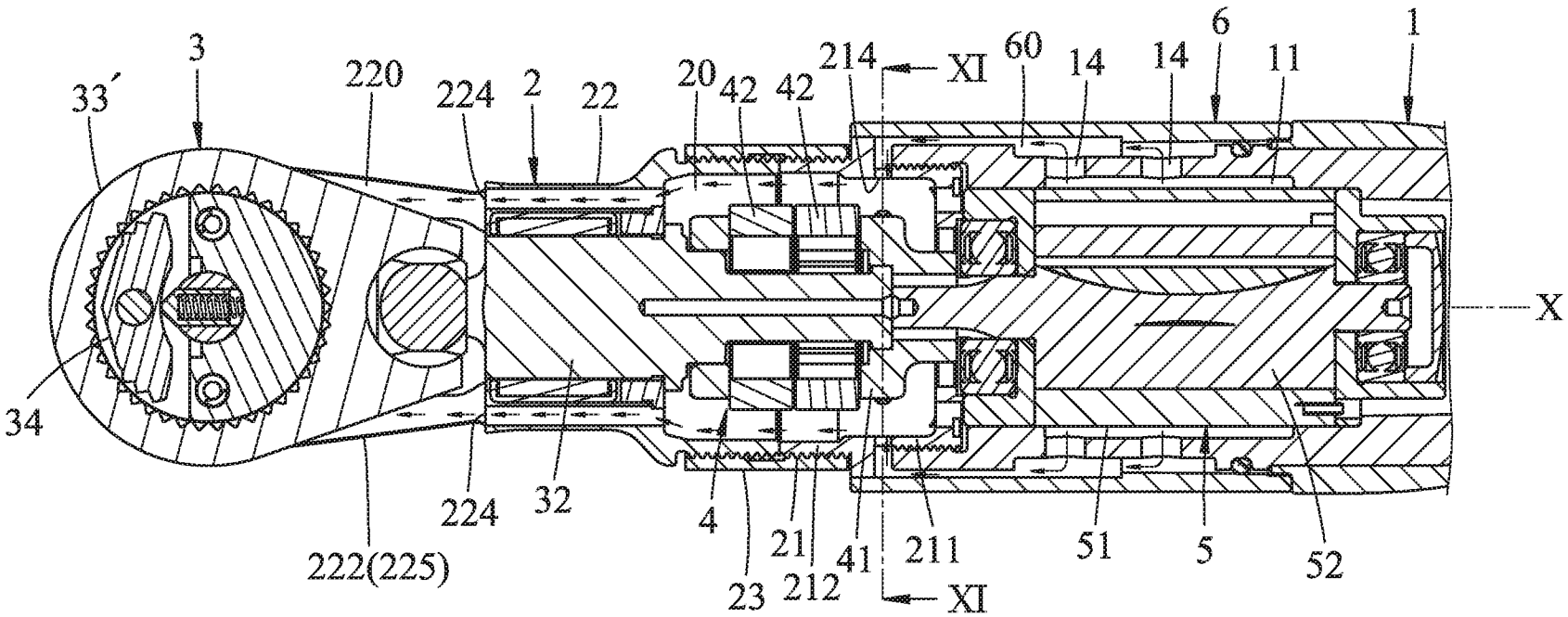
FIG. 10 is a fragmentary sectional view of a fourth embodiment of the pneumatic ratchet wrench according to the present disclosure.
Figure 11:
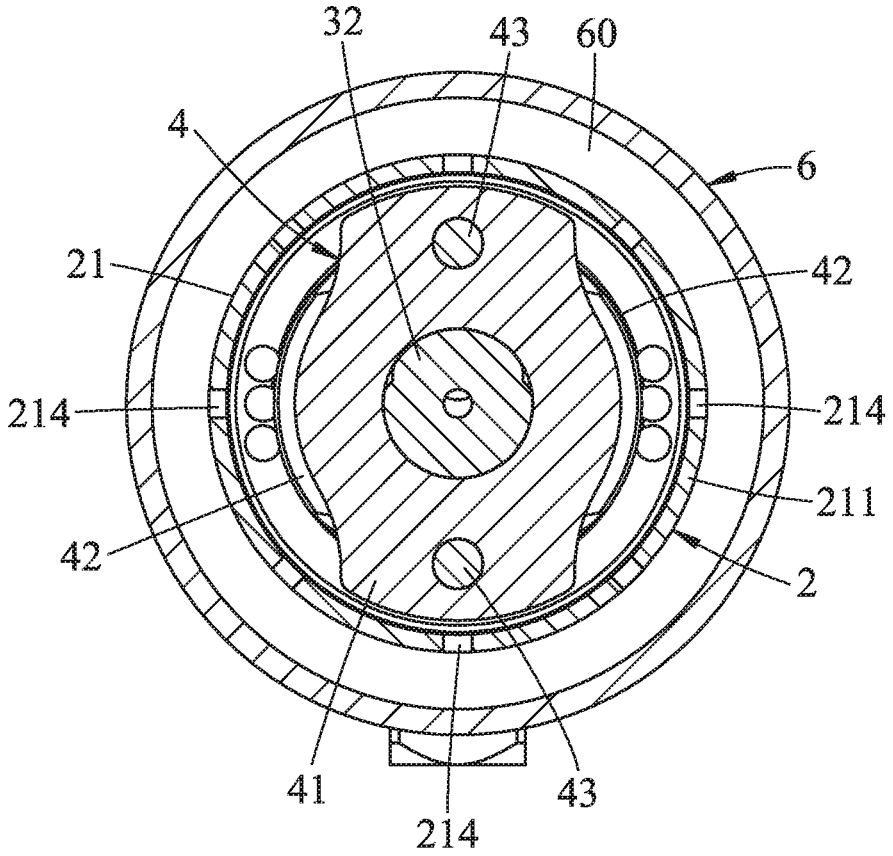
FIG. 11 is a sectional view of the fourth embodiment, taken along line XI-XI of FIG. 10.

Referring to FIGS. 10 and 11, a fourth embodiment of the pneumatic ratchet wrench according to the present disclosure has a structure similar to that of the first embodiment, with differences described below. In the fourth embodiment, the vent holes 14 replace the passages 13 of the first embodiment. The entrances 214 and the exits 224 allow the gas to flow along the central axis (X). The venting space 60 of the collar 6 is in spatial communication between the vent holes 14 and the entrances 214.

During rotation of the driving head 31, the gas exiting the cylinder 51 through the venting hole 511 sequentially passes through the receiving chamber 11, the vent holes 14, the venting space 60, the entrances 214 of the pressing ring portion 211 of the pressing ring 21, the transmission room 20 and the exits 224 to be blown toward the space 220 between the frames 225, so as to cool the yoke 33' (see the arrows in FIG. 10).

In the fourth embodiment, the venting opening 61 (see FIG. 5) is omitted, and the entirety of the gas produced in the cylinder 51 is blown toward the space 220.

Figure 12:
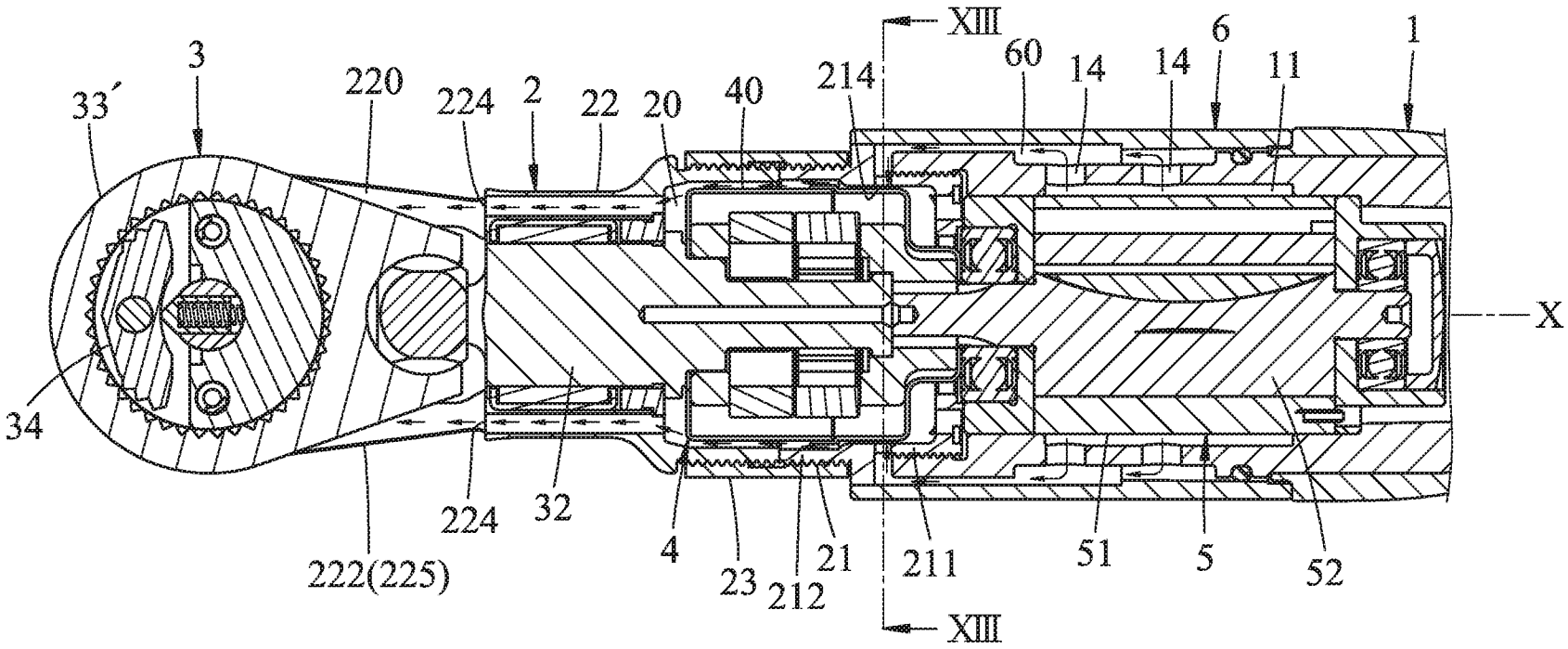
FIG. 12 is a fragmentary sectional view of a fifth embodiment of the pneumatic ratchet wrench according to the present disclosure.
Figure 13:
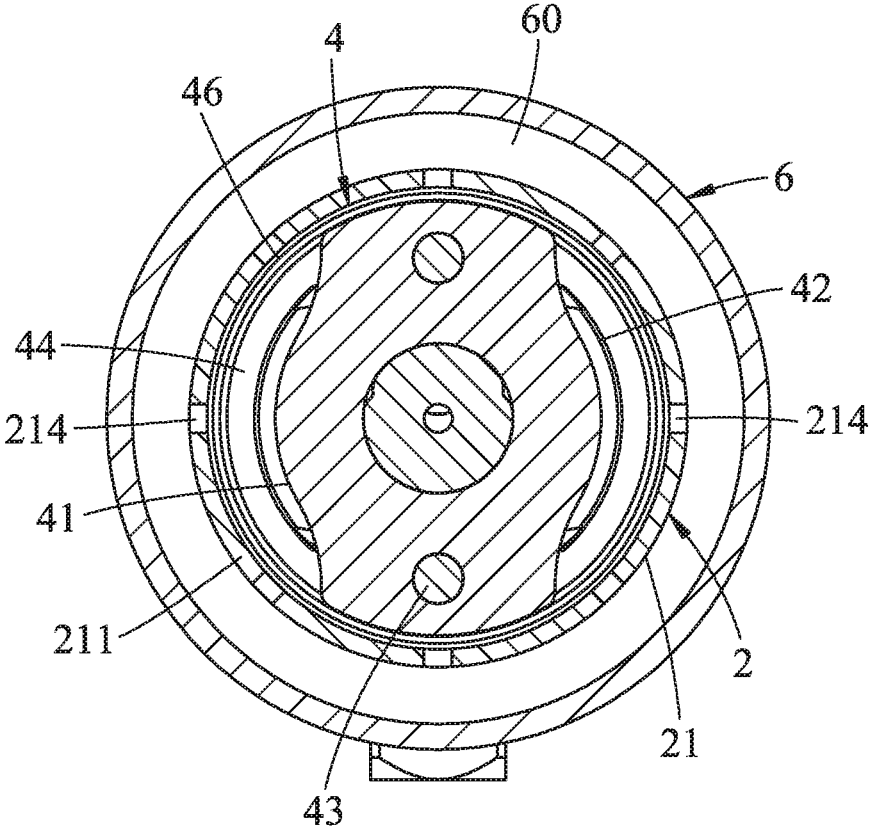
FIG. 13 is a sectional view of the fifth embodiment, taken along line XIII-XIII of FIG. 12.

Referring to FIGS. 12 and 13, a fifth embodiment of the pneumatic ratchet wrench according to the present disclosure has a structure similar to that of the third embodiment, with differences described below. In the fifth embodiment, the vent holes 14 replace the passages 13 of the third embodiment. The entrances 214 and the exits 224 allow the gas to flow along the central axis (X). The venting space 60 of the collar 6 is in spatial communication and disposed between the vent holes 14 and the entrances 214.

During rotation of the driving head 31, the gas exiting the cylinder 51 through the venting hole 511 sequentially passes through the receiving chamber 11, the vent holes 14, the venting space 60, the entrances 214 of the pressing ring portion 211 of the pressing ring 21, the annular passage 40 and the exits 224 to be blown toward the space 220 between the frames 225, so as to cool the yoke 33' (see the arrows in FIG. 12).

Similarly, in the fifth embodiment, the venting opening 61 (see FIG. 9) is omitted, and the entirety of the gas produced in the cylinder 51 is blown toward the space 220.

To sum up, the exits 224 of the pneumatic ratchet wrench are formed in the head unit 2. Therefore, the shape of the main body 1 is not changed and the volume of the main body 1 is not increased, which is more comfortable for a user to handle. The exits 224 are formed in the head 22 instead of the main body 1, and open toward and are adjacent to the space 220 between the frames 225, thereby effectively cooling the driving head 31.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiment but is intended to cover various arrangements included within the spirit and scope of the broadest interpretation so as to encompass all such modifications and equivalent arrangements.

What is claimed is:

1. A pneumatic ratchet wrench comprising:

a main body including a receiving chamber that extends along a central axis;

a head unit defining at least one gas passage, said head unit including a ring portion detachably connected to said main body, and a frame portion extending from said ring portion of said head unit in a direction parallel to the central axis and away from said main body, said ring portion of said head unit including at least one exit that is in spatial communication with said gas passage, that is adjacent to said frame portion, and that opens toward said frame portion;

a driving unit including a driving head that is rotatably mounted to said frame portion and that is rotatable about a rotating axis perpendicular to the central axis, and a transmission shaft that is mounted in said head unit, that extends along a direction parallel to the central axis, and that transmits a driving force to said driving head; and an air motor disposed in said receiving chamber of said main body, pneumatically driving said transmission shaft and including a cylinder and a rotor, said cylinder including a venting hole that allows gas produced in said cylinder to pass through said venting hole and said gas passage and to exit from said exit to be blown toward said frame portion;

wherein said head unit further defines a transmission room that extends along the central axis, that receives said transmission shaft, and that constitutes said gas passage;

wherein said transmission room is in spatial communication with said receiving chamber such that the gas produced in said cylinder passes through said venting hole, said receiving chamber and said transmission room; and wherein said head unit further includes a pressing ring portion that is opposite to said ring portion of said head unit, that is connected to said main body, and that includes at least one entrance in spatial communication with and disposed between said receiving chamber and said transmission room.

2. The pneumatic ratchet wrench as claimed in claim 1, wherein said main body further includes an inner surface that surrounds the central axis and that defines said receiving chamber, and at least one passage that is formed in said inner surface, that extends along the central axis and that is in spatial communication with and disposed between said receiving chamber and said entrance.

3. The pneumatic ratchet wrench as claimed in claim 1, wherein said frame portion is bifurcated and includes two frames that define a space therebetween, said entrance and said exit allowing the gas to flow along the central axis, said exit opening toward and being adjacent to the space between said frames.

4. The pneumatic ratchet wrench as claimed in claim 1, wherein said ring portion of said head unit further includes a stepped portion, said entrance and said exit allowing the gas to flow along the central axis, said exit being formed in said stepped portion.

5. The pneumatic ratchet wrench as claimed in claim 1, wherein said pressing ring portion includes a plurality of said entrances that surround the central axis, said ring portion of said head unit including a plurality of said exits that are respectively in spatial communication with said entrances.

6. The pneumatic ratchet wrench as claimed in claim 1, wherein said head unit further includes a pressing ring and a head, said pressing ring including said pressing ring portion that abuts against said cylinder, and a connection portion that is opposite to said pressing ring portion, said head including said ring portion that is connected to said connection portion, and said frame portion that is connected to said ring portion of said head unit.

7. The pneumatic ratchet wrench as claimed in claim 6, wherein said head unit further includes a packing ring, said pressing ring further including an external thread that is formed in an outer surface of said pressing ring portion and an outer surface of said connection portion, said head further including an external thread that is formed in an outer surface of said ring portion of said head unit, said packing ring including two internal threads that are respectively and threadedly engaged with said external thread of said pressing ring and said external thread of said head.

8. The pneumatic ratchet wrench as claimed in claim 6, further comprising a collar, said main body including a plurality of vent holes that extend along a direction parallel to the rotating axis and that are in spatial communication with said receiving chamber, said entrance of said pressing ring portion allowing the gas to pass therethrough along the direction parallel to the central axis, said collar surrounding said main body and a portion of said pressing ring portion, said collar cooperating with said main body and said connection portion of said pressing ring to define a venting space that is in spatial communication with and disposed between said vent holes and said entrance.

9. The pneumatic ratchet wrench as claimed in claim 1, further comprising a striking unit that is disposed in said transmission room of said head unit, and that includes a striking seat drivable by said rotor, at least one striking block extending through said striking seat and connected to an end of said transmission shaft, and two pins disposed between said striking seat and said striking block and operable to strike said transmission shaft.

10. The pneumatic ratchet wrench as claimed in claim 9, wherein said striking unit further includes an annular seat and an annular cover that is connected to said annular seat and cooperates with said annular seat to define a retaining space receiving said striking seat, said annular seat cooperating with said annular cover and said head unit to define an annular passage that surrounds the central axis and that is in spatial communication with and disposed between said entrance and said exit.

11. An outer shell of a pneumatic ratchet wrench, the pneumatic ratchet wrench including a driving unit and an air motor, the driving unit including a driving head and a transmission shaft that transmits a driving force to the driving head, the air motor including a cylinder and a rotor that is pneumatically driven by the cylinder to drive the transmission shaft, the cylinder including at least one venting hole, said outer shell comprising:

a main body including a receiving chamber that extends along a central axis, that is adapted for receiving the air motor, and that is adapted for receiving gas produced in the cylinder; and a head unit detachably connected to said main body, adapted for the transmission shaft to be mounted therein, and defining at least one gas passage, said head unit including a ring portion that is detachably connected to said main body, and a frame portion that extends from said ring portion of said head unit in a direction parallel to the central axis and away from said main body and that is adapted for the driving head to be rotatably mounted thereto, the driving head being rotatable about a rotating axis perpendicular to the central axis, said ring portion of said head unit including at least one exit that is in spatial communication with said gas passage, that is adjacent to said frame portion, and that opens toward said frame portion, said gas passage guiding the gas produced in the cylinder to be discharged from said venting hole to exit from said exit and to be blown toward said frame portion;

wherein said head unit further defines a transmission room that extends along the central axis, that is adapted for receiving the transmission shaft, and that constitutes said gas passage;

wherein said transmission room is in spatial communication with said receiving chamber such that the gas produced in the cylinder passes through the venting hole, said receiving chamber and said transmission room; and wherein said head unit further includes a pressing ring portion that is opposite to said ring portion of said head unit, that is connected to said main body, and that includes at least one entrance in spatial communication with and disposed between said receiving chamber and said transmission room.

12. The outer shell as claimed in claim 11, wherein said main body further includes an inner surface that surrounds the central axis and that defines said receiving chamber, and at least one passage that is formed in said inner surface, that extends along the central axis and that is in spatial communication with and disposed between said receiving chamber and said entrance.

13. The outer shell as claimed in claim 11, wherein said frame portion is bifurcated and includes two frames that define a space therebetween, said entrance and said exit allowing the gas to flow along the central axis, said exit opening toward and being adjacent to the space between said frames.

14. The outer shell as claimed in claim 11, wherein said ring portion of said head unit further includes a stepped portion, said entrance and said exit allowing the gas to flow along the central axis, said exit being formed in said stepped portion.

15. The outer shell as claimed in claim 11, wherein said pressing ring portion includes a plurality of said entrances that surround the central axis, said ring portion of said head unit including a plurality of said exits that are respectively in spatial communication with said entrances.

16. The outer shell as claimed in claim 11, wherein said head unit further includes a pressing ring and a head, said pressing ring including said pressing ring portion that is adapted for abutting against said cylinder, and a connection portion that is opposite to said pressing ring portion, said head including said ring portion that is connected to said connection portion, and said frame portion that is connected to said ring portion of said head unit.

17. The outer shell as claimed in claim 16, wherein said head unit further includes a packing ring, said pressing ring further including an external thread that is formed in an outer surface of said pressing ring portion and an outer surface of said connection portion, said head further including an external thread that is formed in an outer surface of said ring portion of said head unit, said packing ring including at least one internal thread that is threadedly engaged with said external thread of said pressing ring and said external thread of said head.

18. The outer shell as claimed in claim 16, further comprising a collar, said main body including a plurality of vent holes that extend along a direction parallel to the rotating axis and that are in spatial communication with said receiving chamber, said entrance of said pressing ring portion allowing the gas to pass therethrough along the direction parallel to the central axis, said collar surrounding said main body and a portion of said pressing ring portion, said collar cooperating with said main body and said connection portion of said pressing ring to define a venting space that is in spatial communication between said vent holes and said entrance.

19. The outer shell as claimed in claim 11, the pneumatic ratchet wrench further includes a striking unit that is disposed in said transmission room of said head unit, and that includes a striking seat drivable by the rotor, at least one striking block extending through the striking seat and connected to an end of the transmission shaft, and two pins disposed between the striking seat and the striking block and operable to strike the transmission shaft, the striking unit further including an annular seat and an annular cover that is connected to the annular seat and cooperates with the annular seat to define a retaining space receiving the striking seat, wherein said head unit is adapted to cooperate with the annular seat and the annular cover to define an annular passage that surrounds the central axis and that is in spatial communication between said entrance and said exit.

* * * * *